US005598605A

United States Patent [19]

Tomasiak

[11] Patent Number: 5,598,605

[45] Date of Patent: Feb. 4, 1997

[54] WET/DRY UTILITY VACUUM CLEANER WITH A WHEEL MOUNT

[75] Inventor: Mark J. Tomasiak, O'Fallon, Mo.

[73] Assignee: Emerson Electric Co., St. Louis, Mo.

[21] Appl. No.: 528,356

[22] Filed: Sep. 14, 1995

Related U.S. Application Data

[62] Division of Ser. No. 303,689, Sep. 9, 1994, Pat. No. 5,528, 794.

[51] Int. Cl.[6] ..... A47B 91/00; B60B 33/00

[52] U.S. Cl. ..... 16/45; 16/38; 16/31 R; 301/111

[58] Field of Search ..... 16/45, 30, 35 R, 16/38, 39, 31 R, 40, 43; 301/111, 112, 121

[56] References Cited

U.S. PATENT DOCUMENTS

| | | | |
|---|---|---|---|
| 3,890,020 | 6/1975 | Thomas | 308/16 |
| 4,007,820 | 2/1977 | Kagata | 192/67 |
| 4,054,335 | 10/1977 | Timmer | 308/191 |
| 4,121,871 | 10/1978 | Adams, Jr. | 301/105 |
| 4,229,855 | 10/1980 | Rowe | 16/31 R |
| 4,392,333 | 7/1983 | Welsch | 51/170 |
| 4,404,707 | 9/1983 | Walker | 16/31 |
| 4,530,543 | 7/1985 | Keane | 16/45 |
| 4,544,425 | 10/1985 | Provolo | 156/73.1 |
| 4,689,848 | 9/1987 | Kotzin | 16/46 |
| 4,955,669 | 9/1990 | Jankevies | 301/111 |
| 5,143,500 | 9/1992 | Schuring et al. | 16/38 |
| 5,209,167 | 5/1993 | Donner et al. | 105/180 |
| 5,222,786 | 6/1993 | Sovis et al. | 301/111 |
| 5,340,206 | 8/1994 | Young | 305/24 |

FOREIGN PATENT DOCUMENTS

| | | | |
|---|---|---|---|
| 2607754 | 6/1988 | France | 301/112 |

*Primary Examiner*—Chuck Y. Mah

*Attorney, Agent, or Firm*—Polster, Lieder, Woodruff & Lucchesi

[57] ABSTRACT

A utility vacuum cleaner tool caddy for utility vacuum cleaner drums as well as an axleless wheel mount are disclosed. The tool caddy has rear and front wheels with integral rear and front bumpers at least partially overlying the rear and front wheels. This provides a wider/larger wheel base/caddy which increases the stability of the utility vacuum cleaner during movement. The rear bumper is also provided with a plurality of spaced openings for receiving a corresponding number of vacuum tools which are stored in an out-of-way location when moving or storing the utility vacuum cleaner. The axleless wheel mount provides a snap-in mounting of individual wheels with full bearing support, thus eliminating the need of an axle between spaced and aligned wheels. Additionally, the wheel support increases the load capacity while improving the overall look and appearance of the base unit or tool caddy.

7 Claims, 6 Drawing Sheets

WET/DRY UTILITY VACUUM CLEANER WITH A WHEEL MOUNT

This is a divisonal of application Ser. No. 08/303,689, filed on Sep. 9, 1994, now U.S. Pat. No. 5,528,794.

CROSS REFERENCE TO RELATED APPLICATIONS

This is a related copending application to Serial No. 08/332,591, filed Oct. 31, 1994, entitled WET/DRY UTILITY VACUUM CLEANER WITH DETACHABLE BLOWER, which is assigned to the same assignee as the present invention.

BACKGROUND OF THE INVENTION

The present invention relates to a utility vacuum cleaner tool caddy for associated utility vacuum drums as well as an axleless wheel mount used in such a tool caddy or with other supporting frames, as may be desired.

Typical prior utility vacuum cleaners are provided with a power source that is mounted above a vacuum cleaner drum. A vacuum hose is connected to the power source for generating a partial vacuum in the hose in order to collect debris within the vacuum cleaner drum. In order to readily move the utility vacuum cleaner to a desired location, it is common to provide a combination of wheel casters and/or wheels mounted below the vacuum cleaner drum. One or more wheel casters are generally provided at the front of the vacuum cleaner drum while larger wheels are provided at the rear. This provides an easily moving unit with free turning, as desired. Examples of utility vacuum cleaners employing this general construction are shown in U.S. Pat. Nos. 2,819,485 and 3,358,316.

Some of the prior art wet/dry utility vacuum cleaners are provided with a carriage or a base on which such wheel casters and/or wheels are mounted. Examples of a carriage or base constructed in this matter are shown in U.S. Pat. Nos. 3,063,082 and 4,222,145.

The present invention is directed to a utility vacuum cleaner base or caddy for receiving a variety of similarly sized utility vacuum drums which is constructed to provide a strong and durable one-piece molded unit with increased stability and load carrying capacity, while at the same time providing for the convenient storage area of vacuum cleaner tools at the rear of the vacuum cleaner drum where they are positioned in an out-of-way location during movement of the utility vacuum cleaner between various locations. Additionally, the present invention provides a new and improved wheel mount construction which enables wheels to be mounted directly to the tool caddy or base, without the need for an axle between spaced and aligned wheels. The wheel mount construction can also be used with other supporting frames.

SUMMARY OF THE INVENTION

Among the several objects and advantages of the present invention include:

The provision of a new and improved wet/dry utility vacuum cleaner which includes a tool caddy for receiving one of a variety of similarly sized utility vacuum drums;

The provision of the aforementioned tool caddy which is constructed as a one-piece molded unit with integral rear and front bumpers for at least partially overlying rear and front wheels of the tool caddy base;

The provision of the aforementioned tool caddy which includes a wider/larger tool caddy or base that has increased stability of the wet/dry utility vacuum cleaner during movement;

The provision of the aforementioned tool caddy which includes a plurality of openings in the rear bumper for receiving a corresponding number of vacuum tools which can be stored in an out-of-way location when moving or storing the wet/dry utility vacuum cleaner;

The provision of the aforementioned tool caddy which is strong and durable, has increased stability and load carrying capacity, is made of a minimum number of parts and is otherwise well adapted for the purposes intended;

The provision of an axleless wheel mount that can be used with the tool caddy or other supporting frame for the mounting of individual wheels without the need for an axle between spaced and aligned wheels;

The provision of the aforementioned axleless wheel mount which provides a snap-in mounting of individual wheels relative to the tool caddy or other supporting frame; and The provision of the aforementioned axleless wheel mount which is strong and durable, provides easy assembly of wheels relative to the tool caddy or other supporting frame, is made of a minimum number of parts and is otherwise well adapted for the purposes intended.

Briefly stated, the utility vacuum cleaner tool caddy of the present invention is adapted to be used with one of a variety of similarly sized utility vacuum drums. The tool caddy is supported by front and rear wheels and includes an internal depression corresponding in shape and size to a lower end portion of one of a number of similarly sized utility vacuum drums for receiving same within the internal depression. The tool caddy includes integral rear and front bumpers at least partially overlying the rear and front wheels of the tool caddy. The rear bumper is provided with a plurality of spaced openings for receiving a corresponding number of vacuum tools that can be stored in an out-of-way location during movement of the utility vacuum cleaner.

The front and rear wheels comprise front and rear pairs of spaced wheels. The front pair of wheels are preferably wheel casters while the rear pair of wheels are all-terrain type wheels which are larger than the wheel casters at the front of the tool caddy in order to enable the tool caddy to traverse rough and uneven terrain with relative ease.

The tool caddy and its integrally associated rear and front bumpers are molded as a one-piece unit to provide a stable construction during movement with increased load carrying capacity.

The rear bumper at least partially overlies the rear pair of spaced wheels while the front bumper includes spaced integral bumper sections each at least partially overlies one of the front pair of spaced wheels. The rear and front bumpers are shaped, dimensioned and configured to protect the rear and front pairs of wheels from impact regardless of direction of movement of the tool caddy and its associated utility vacuum drum.

The spaced tool openings in the rear bumper include internally spaced projections for engagement with associated tools. The internal space projections are dimensional relative to the openings for frictional engagement with such tools.

The axleless wheel mount rotatably mounts a wheel relative to a supporting frame such as the tool caddy or base. The axleless wheel mount includes a wheel having a central axis and a wheel support that is positioned adjacent to the wheel and extends generally transversely to the wheel axis. The wheel support includes rotatable wheel supporting means for rotatably mounting the wheel relative to the wheel supporting plate. The wheel includes locking means for locking engagement with the wheel support independent of the rotatable wheel supporting means. The wheel support extends above the wheel for cooperative interengagement with an associated supporting frame such as the tool caddy or base for mounting the wheel relative to the supporting frame.

The wheel mount includes at least one pair of wheel mounts which are constructed in the manner set forth above for mounting on opposite sides of the supporting frame with the central axis of each wheel in alignment with each another in order to provide an axleless wheel mount for each such pair of wheel mounts on the supporting frame.

Preferably, the wheel includes an integral centrally positioned axle element that extends transversely relative to the wheel. The wheel support has a complementary shaped wheel axle element opening for rotatably receiving the wheel axle element in a rotatable mounted construction. The wheel axle element has a predetermined length greater than the predetermined thickness of the wheel support and terminates in an outer free end spaced from the wheel. Deflectable shoulder means are provided at the outer free end of the wheel axle element. The-deflectable shoulder means have a predetermined width greater than the complementary shaped wheel axle element opening for partial inward deflection of the deflectable shoulder means during assembly of the wheel to the wheel support. The deflectable shoulder means subsequently expands to its predetermined width when the deflectable shoulder means extends beyond the complementary shaped wheel axle element opening for locking engagement with the rear wall of the wheel support. This also positions the wheel in proximity to the front wall of the wheel support. The wheel support includes an integral frame plate extending above the wheel for cooperative interengagement with an associated supporting frame such as the tool caddy or base in order to mount the wheel support to the supporting frame while permitting rotation of the wheel relative to the wheel support.

The wheel is connected to the wheel axle element adjacent an inner end. The wheel includes a transversely extending wall that surrounds the wheel axle element and terminates in a generally circular wall that extends normal to the transversely extending wall in generally parallel relationship to the wheel axle element.

The deflectable shoulder means include deflectable finger segments that are integral with the wheel axle element and terminate in a radially enlarged shoulder at an outer free end of the wheel axle element.

The integral frame plate of the wheel support includes a fan shaped element that is adapted to be received in a complementary shaped opening provided in the supporting frame.

These and other objects and advantages of the present invention will become more apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way of limitation. The description will clearly enable one skilled in the art to make and use the invention, and describes several embodiments, adaptions, variations, alternatives and uses of the invention, including what we presently believe is the best mode of carrying out the invention.

Figure 2:
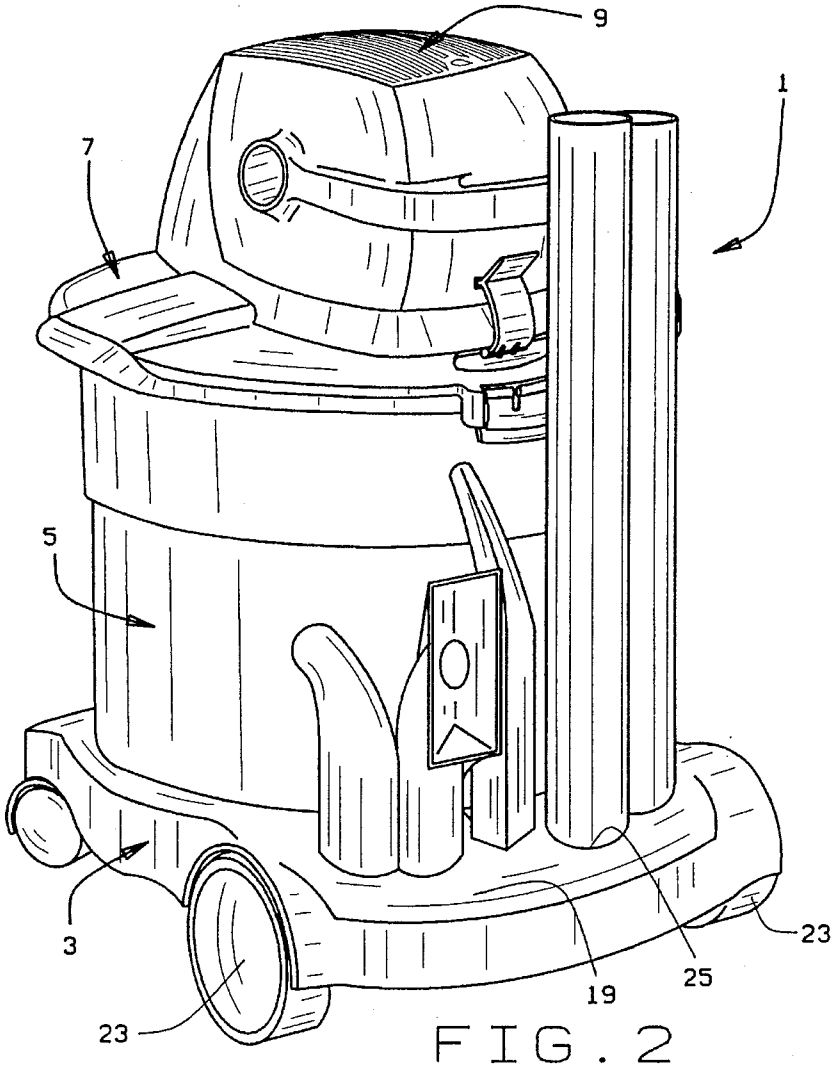
FIG. 2 is a rear perspective view of the wet/dry utility vacuum cleaner illustrated in FIG. 1 and illustrating the manner in which vacuum tools are mounted to the tool caddy.
Figure 1:
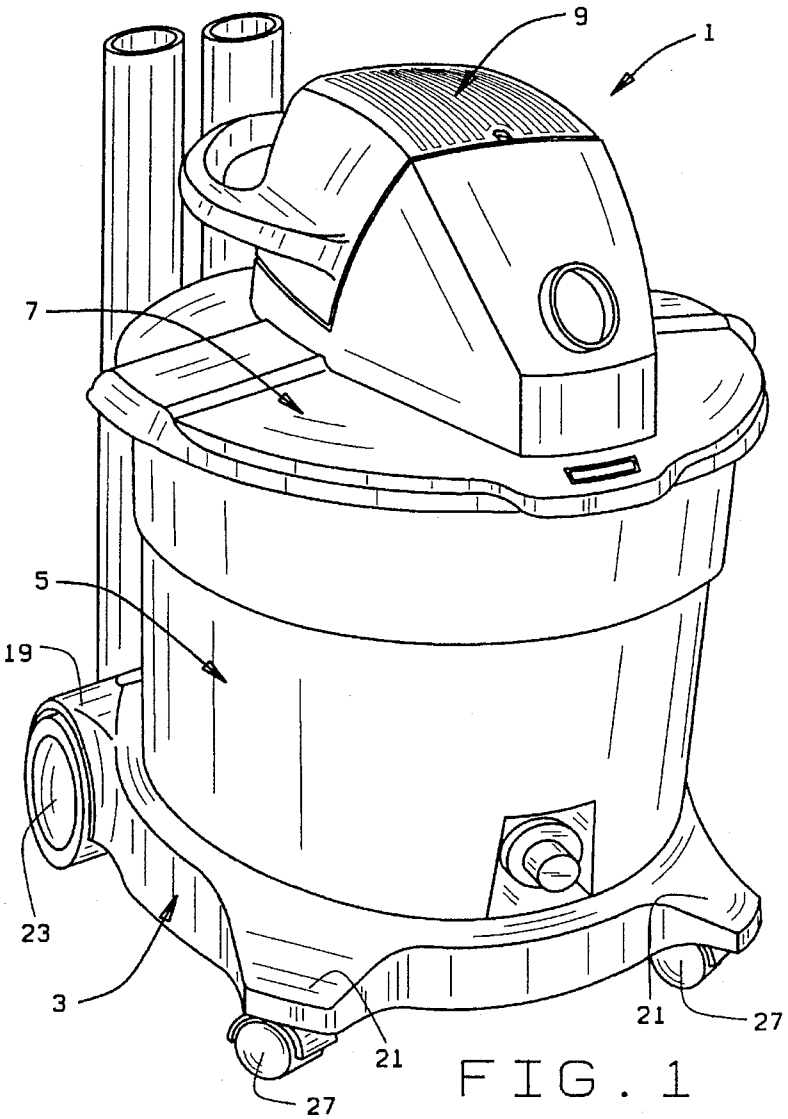
FIG. 1 is a front perspective view of a wet/dry utility vacuum cleaner which incorporates the tool caddy and wheel mount of the present invention.

The wet/dry utility vacuum cleaner 1 shown in FIGS. 1–2 of the drawings includes the tool caddy 3 to which the present invention is directed, a utility vacuum drum 5 received within the tool caddy 3, a lid 7 that covers the open upper end of the vacuum cleaner drum 5, and a detachable blower 9 that is received within complementary shaped cavities or openings of the lid 7 and is capable of being separated from the lid 7 for independent use, as desired. Reference is made to aforementioned copending patent application Ser. No. 08/382,591, filed Oct. 31, 1994, for a detailed description of the construction and operation of the wet/dry utility vacuum cleaner 1 and its drum 5, lid 7 and detachable blower 9 components.

Attention is now directed to the tool caddy 3, as best illustrated in FIGS. 1–6 of the drawings, and its associated wheel mount as illustrated in FIGS. 7–12 of the drawings, which constitute the subject matter of the present invention.

The utility vacuum cleaner tool caddy 3 is constructed as a one-piece molded unit from polypropylene or other similar suitable material. A central section 11 is formed with an internal depression 13 conforming to the shape of the lower end of the vacuum drum 5. For complementary mounting and support of similar size utility vacuum drums 5 within the internal depression 13, a circular shoulder 15 and a series of web elements 17 are provided.

On opposite sides of the central section 11, the tool caddy 3 is provided with a rear bumper 19 and front bumper sections 21, 21. The rear bumper 19 performs two functions. First, it serves as a bumper element for the spaced wheels 23, 23. Secondly, it provides a plurality of spaced tool openings 25 for receiving vacuum tools as illustrated in FIGS. 1–2 of the drawings. The spaced front bumper sections 21, 21 are each adapted to overlie and protect an individual wheel caster that is mounted within the bumper section 21, 21 in a similar manner. The rear bumper 19 and the front bumper sections 21, 21 protect the rear wheels 23, 23 and the wheel casters 27, 27, regardless of direction of movement of the tool caddy 3.

As compared to the small wheel casters 27, 27, the rear pair of spaced wheels 23, 23 are all-terrain type wheels which require the bumper 19 to be larger than the front bumper sections 21, 21. It will be noted that the construction of the rear bumper 19 provides circumferential protection to the rear wheels 23 above and on opposite sides thereof as best illustrated in FIGS. 1–4 and 6. Additionally, the rear bumper 19 has an enlarged generally curvilinear pattern that follows the generally circular shape of the central section 11. This shape enables spaced tool openings 25 to be formed along the length of the rear bumper 19 between the rear wheels 23, 23. As illustrated in the drawings, there are four tool openings 25 and one tool opening 33 provided, although this number may be varied, as desired.

Figure 4:
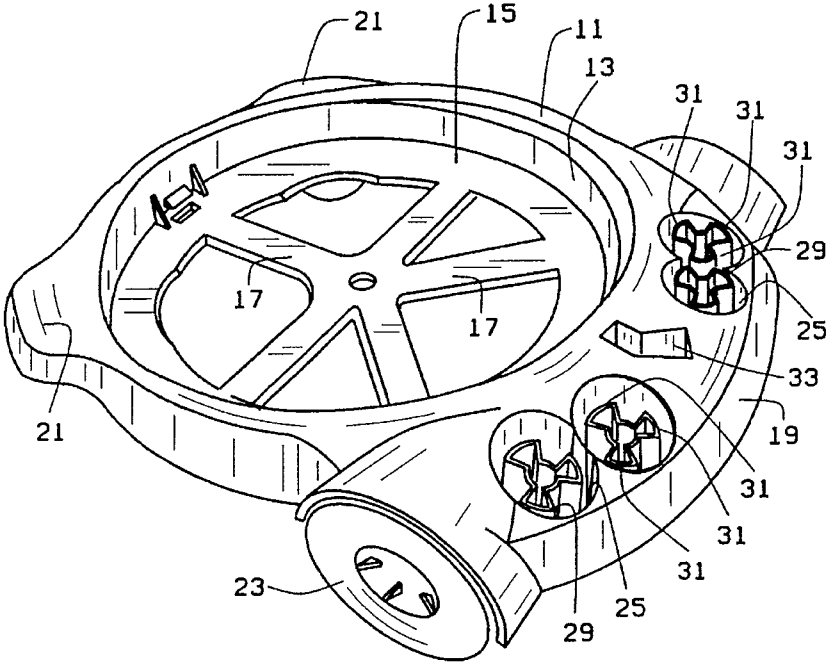
FIG. 4 is a rear perspective view of the tool caddy of the present invention.
Figure 3:
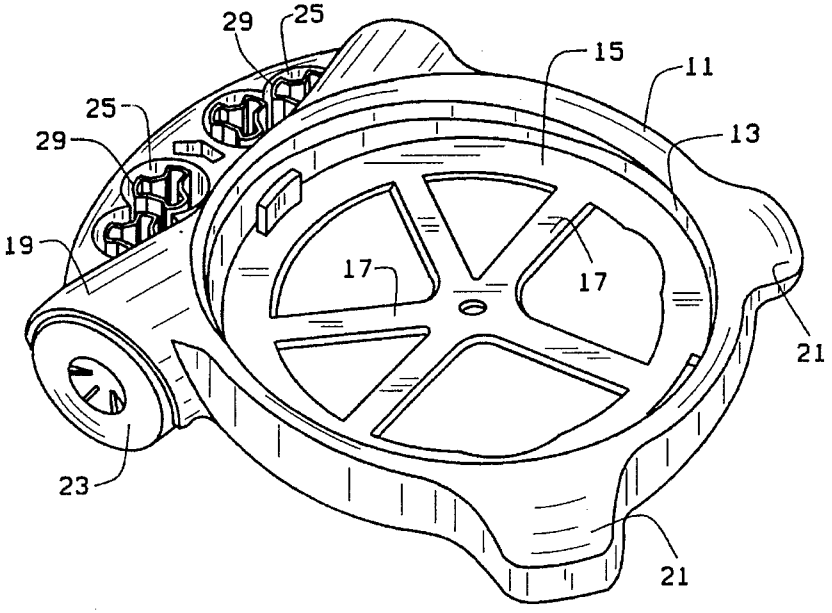
FIG. 3 is a front perspective view of the tool caddy of the present invention.
Figure 5:
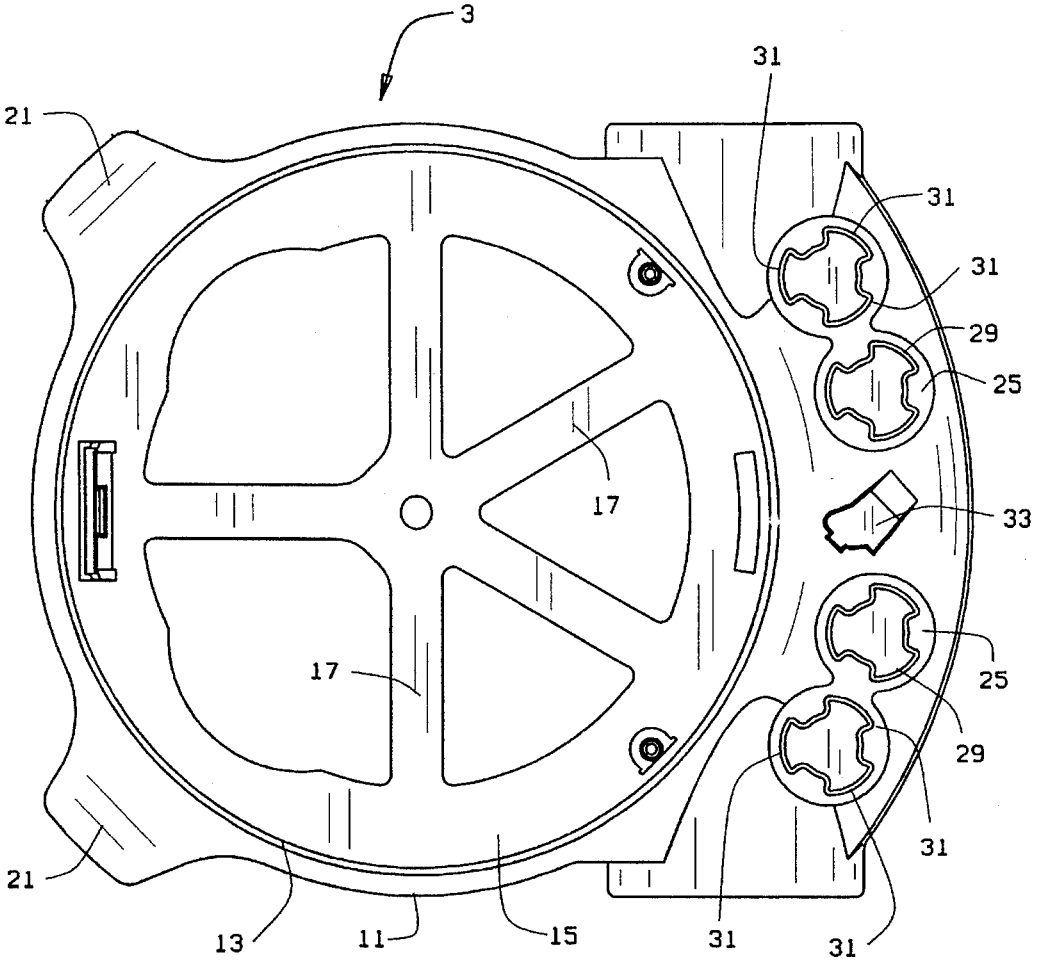
FIG. 5 is a top plan view of the tool caddy of the present invention.
Figure 6:
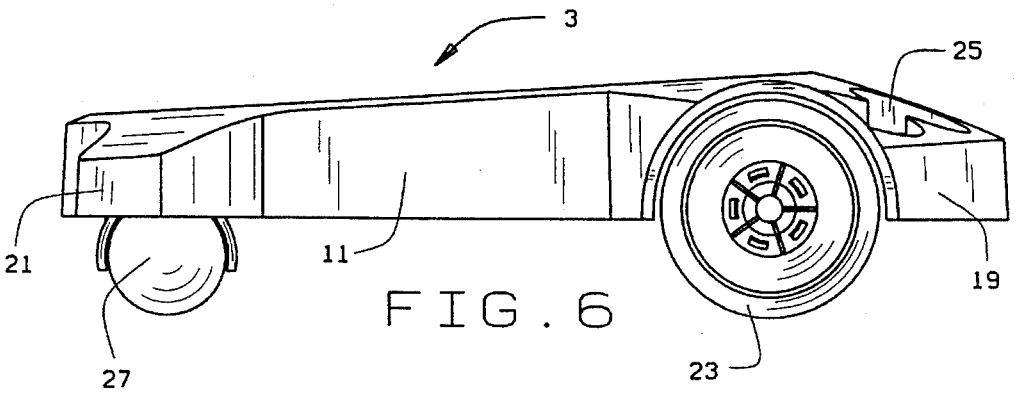
FIG. 6 is a side elevational view of the tool caddy of the present invention.
Figure 7:
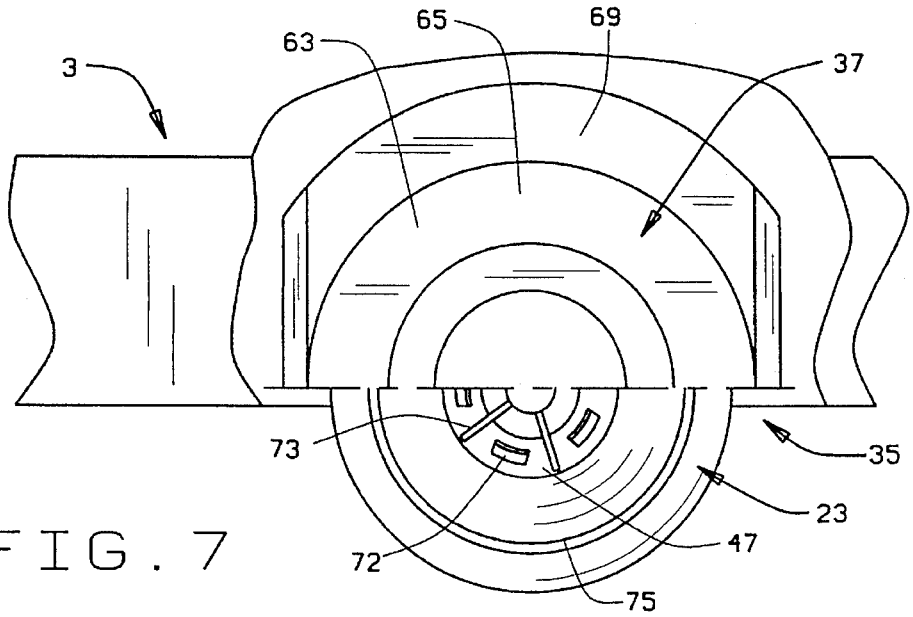
FIG. 7 is a side elevational view of a wheel mount with associated wheel in assembled position relative to the tool caddy or supporting frame.

Four of the tool openings 25 include internally spaced projections 29, each of which comprise three equally spaced hollow generally wedge-shaped projections 31 that are interconnected to one another along their inner ends, as best illustrated in FIGS. 4 and 5. The distance between the outer circumferential margins of the three generally wedge-shaped projections 31 and the inner wall of the tool openings 25 enables the vacuum cleaner tools and tubes illustrated in the drawings to be received in friction fit engagement. This permits the vacuum tools and tubes illustrated in FIGS. 1–2 of the drawings to be readily mounted within the spaced openings 25 without disassociation from the rear bumper 19. The tool opening 33 is specially configured as illustrated in FIGS. 4 and 5 to receive a vacuum nozzle or head, as illustrated in FIG. 2 of the drawings. Quite obviously, other shapes and configurations, in addition to numbers and sizes, can be employed for the openings 25 and 33, as may be desired.

Reference is now made to the wheel mount 35 illustrated in FIGS. 7–12 of the drawings. The wheel mount 35 includes the wheel 23 which is rotatably mounted and secured to the wheel support 37, the latter in turn being mounted to the tool caddy 3 in the vicinity of the rear bumper 19. Both the wheel 23 and the wheel mount 37 are injection molded from a suitable plastic material, polypropylene being one preferred example.

The wheel 23 includes an integrally centrally positioned axle element 39 that extends generally transversely to the wheel 23. The integral centrally positioned wheel axle element 39 is a generally cylindrically shaped hollow element, closed at an outer end 41 and configured and sized to visually represent an axle element. However, the wheel mount 35 of the present invention is axleless in the sense that there is no axle between spaced pairs of wheels 23, 23. Instead, the wheel 23 is rotatably and securably mounted to the wheel mount 37 in the unique manner presently being described.

It will be noted that the integral centrally positioned wheel axle element 39 of the wheel 23 is connected along a central portion thereof to a transverse wall 43. The transverse wall 43 is connected to both a generally circular wall 45 that is axially spaced from and is generally parallel to the wall of the cylindrically shaped wheel axle element 39, as well as to a tapered wall 47. The tapered wall 47 is connected at one end to the transverse wall 43 and at a second end to the transverse wheel wall 49. The transverse wall 49 terminates in and is connected to a circular wheel wall 51 that is spaced from and generally parallel to the circular wall 45 which surrounds and is also generally parallel to the cylindrically shaped wheel axle element 39.

The above described structure of the wheel 23 aesthetically provides, in a one piece construction, a typically looking wheel with axle, even though there is no axle in the wheel 23. Additionally, the manner in which the outer circular wheel wall 51 of the wheel 23 is structurally configured and interconnected to the various above described supporting walls provides sufficient wheel support in the novel and unique one-piece wheel construction described above.

Figure 8:
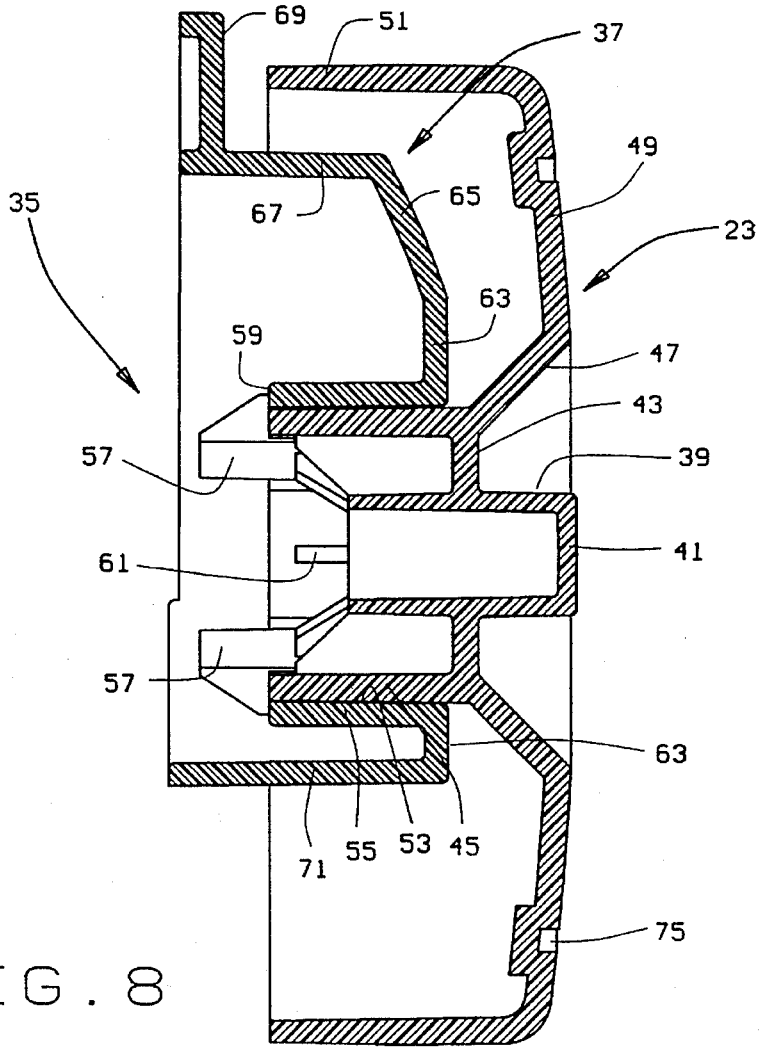
FIG. 8 is a sectional view of the wheel and wheel support mounted in the tool caddy or supporting frame.
Figure 9:
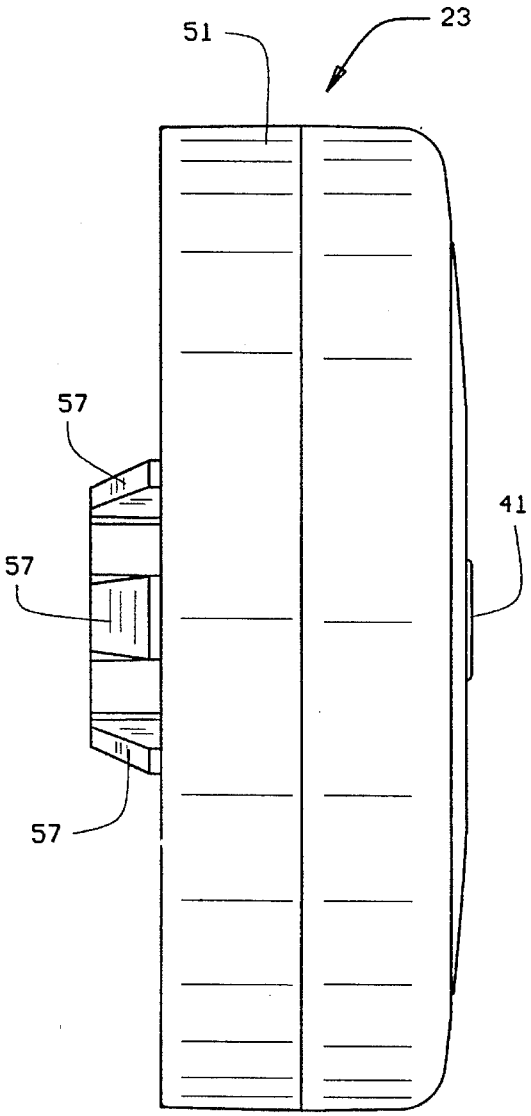
FIG. 9 is a side elevational view of the wheel mounted in the tool caddy or supporting frame.
Figure 10:
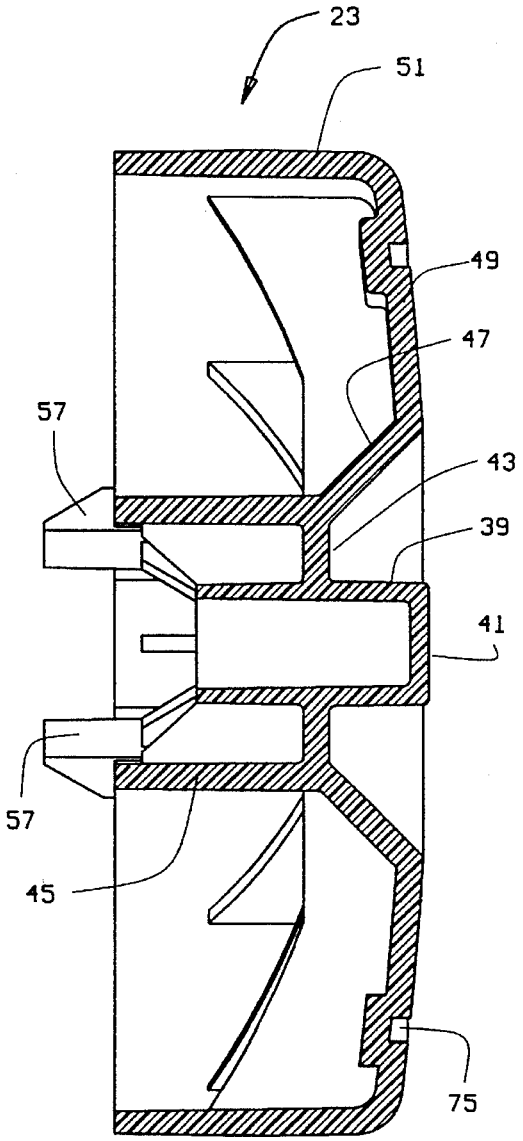
FIG. 10 is a sectional view of the wheel mounted in the tool caddy or supporting frame.
Figure 11:
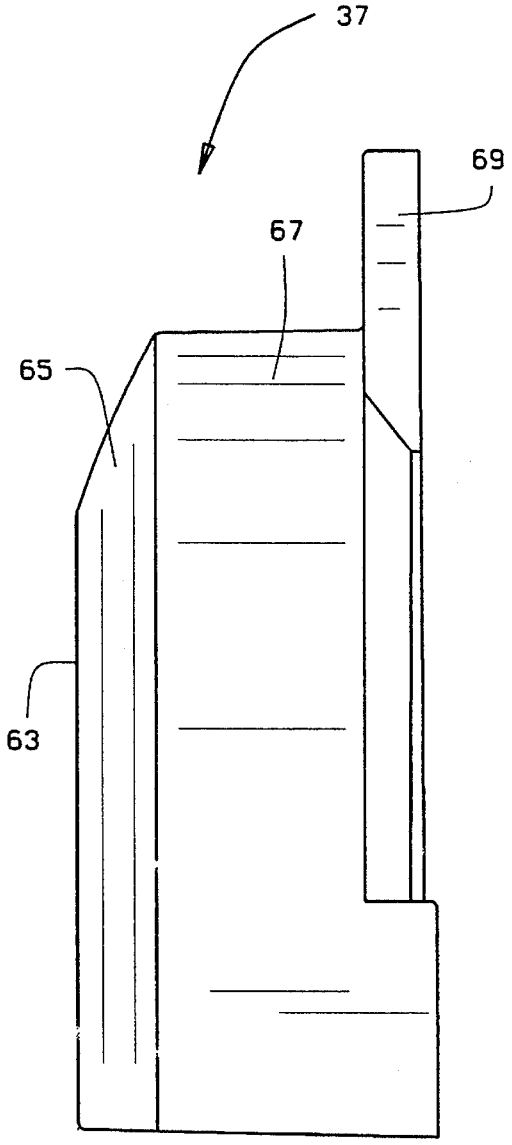
FIG. 11 is a side elevational view of the wheel support and wheel separate from the tool caddy or supporting frame.
Figure 12:
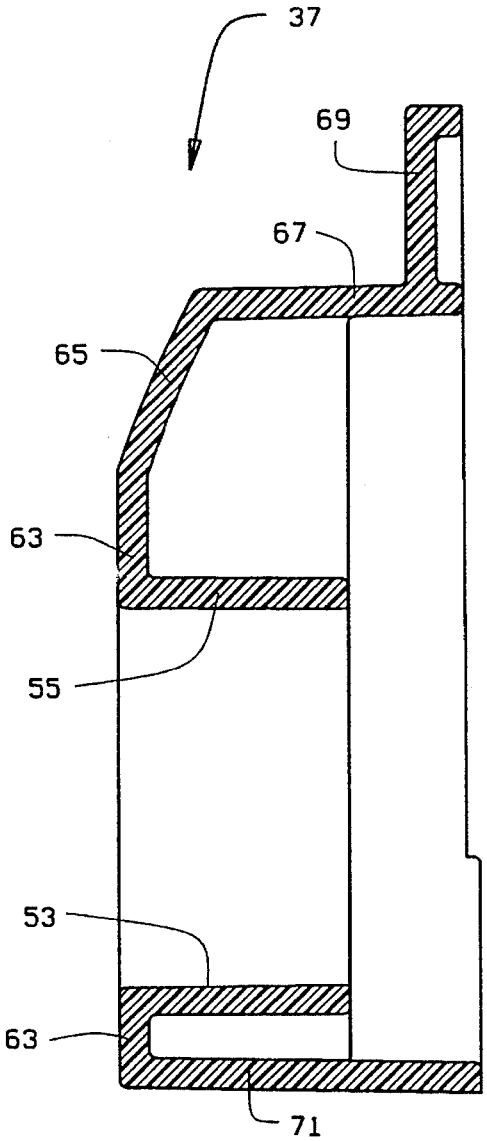
FIG. 12 is a sectional view of the wheel support and included wheel separate from the tool caddy or supporting frame.

For mounting the wheel 23 relative to the wheel support 37, the integral circular wall 45 of the wheel 23 is adapted to be rotatably mounted within a complementary shaped wheel axle element opening 53 of a circular wall support 55. The relative dimensional relationships between the outer diameter of the circular wall 45 and the inner diameter of the circular wall support 55 are such that the wheel 23 is suitably rotatably mounted with bearing support within the wheel mount 37, as will be discussed below. Additionally, for securing the wheel 23 relative to the wheel mount 37, the wheel axle element 39 includes a series of circumferentially spaced inwardly deflectable shoulders 57, the outer diametrical extent of which are greater than the inner wall periphery or diameter 53 of the circular wall support 55 such that they are radially deflected inwardly during assembly of the wheel 23 relative to the wheel support 37. As best seen in FIG. 8 of the drawing, the circumferentially spaced deflectable shoulders 57 have a length greater than the circular wall support 55 such that once the circumferentially spaced deflectable shoulders 57 pass beyond the circular wall support 55 of the wheel mount 37, the circumferentially spaced deflectable shoulders will return to their predetermined condition for engaging a rear wall portion 59 of the circular wall support 55, in order to prevent retrograde or withdrawal movement of the wheel 23 relative to the wheel support 37.

As best seen in FIG. 8, a portion of the spaced deflectable shoulders 57 also underlie and provide a bearing support for the circular wall support 55 and eliminate the need for a separate bearing element.

Adjacent circumferentially spaced deflectable shoulders 57 are separated by an intervening slot 61 in the circumferential wall 45, in order to allow radial inward and outward deflection of the circumferentially spaced shoulders 57 as described above. Once the wheel 23 is assembled relative to the wheel support 37 in the manner described above, it will be seen that the wheel 23 is both rotatably mounted as well as secured in locking engagement relative to the wheel support 37.

The wheel support 37, in addition to the circular wall support 55, includes a transversely extending front wall portion 63 that also preferably angles away from the wheel 23 in the tapered wall portion 65 adjacent an upper end. Integrally connected to the tapered wall portion 65 of the front wall 63 is an upper semi-circular wall support 67 which is integrally connected at an outer end to a curvilinear frame plate 69 that extends above the wheel supporting wall 51 for cooperative interengagement with a complementary shaped opening formed in the tool caddy 3 or other associated supporting frame. Below the circular wall support 55 of the wheel mount 37, the front wall 63 extends for a distance smaller than its dimensional extent above the circular wall support 55 and is connected to lower planar wall support 71. It will be appreciated that the lower front wall 63 and planar wall support 71 provide a suitable structural support for underlying the rotatable mounting of the wheel 23 relative to the wheel mount 37. At the same time, the wheel mount 37 above the circular wall 55 enables the wheel mount 37 to be mounted relative to the tool caddy 3 or other associated supporting frame, through the complementary interconnected mounting of the integral, fan-shaped frame plate 69 relative to an associated complementary opening or slot formed in the tool caddy or other associated supporting frame. It will be appreciated that the integral frame plate 69 must be suitably retained in place relative to the tool caddy 3 or other associated supporting frame. This can be accomplished through a variety of different fastening techniques, in order that the wheel mount 37 can be fixed in place relative to the tool caddy or other associated supporting frame.

It can thus be seen that the wheel 23 is rotatably mounted while being secured in locking engagement relative to the wheel mount 37. At the same time, the wheel mount 37 is itself suitably mounted and secured relative to the tool caddy 3 or other associated supporting frame.

In order to maintain the aesthetics of the wheel 23, suitable circumferentially spaced openings 72 may be formed in the tapered wall 47 of the wheel 23 with an axially extending groove 73 between adjacent circumferentially spaced slots 71. This gives the appearance of a wheel axle mounting. Additionally, a circular groove 75 may be formed in the transverse wheel wall 49 to give the appearance of a wheel mounted on a wheel axle. Thus, the wheel 23 can maintain the aesthetic look of a typical wheel construction while providing a one-piece integrally molded wheel 23 that is rotatably mounted and secured in the wheel mount 37.

From the foregoing, it will now be appreciated that the utility vacuum cleaner tool caddy may be constructed as a one-piece molded unit with integral rear and front bumpers that at least partially overlie rear and front wheels of the tool caddy, while providing a plurality of openings in the rear bumper for receiving a corresponding number of vacuum tools that can be stored in an out-of-way location when moving or storing the wet/dry utility vacuum cleaner. The tool caddy is strong and durable while providing increased stability and load carrying capacity as compared to other prior art designs. In addition to the aforementioned tool caddy, the axleless wheel mount of the present invention provides for the mounting of individual wheels without the need for an axle between spaced and aligned wheels in the tool caddy or other associated supporting frame. The individual wheels are rotatably mounted and secured in locking engagement relative to a wheel support that is, in turn, supported by the tool caddy or other associated supporting frame. The wheel mount thus provides a strong and durable wheel and wheel support construction in a minimum number of parts which can be easily assembled to one another while retaining the overall aesthetic look and appearance of a typical wheel construction.

In view of the above, it will be seen that the several objects and features of this invention are achieved and other advantageous results obtained.

As various changes could be made in the above construction without departing from the scope of the invention, it is intended that all matter contained in the above description or shown in the accompanying drawings shall be interpreted as illustrative and not in a limiting sense.

I claim:

1. A wheel mount for rotatably mounting a wheel relative to a supporting frame, comprising:

a wheel having an integral centrally positioned axle extending transversely relative to said wheel;

a wheel support for rotatably mounting the wheel relative to the wheel support;

the wheel axle having a transversely extending wall that surrounds the wheel axle and terminates in a generally circular wall that is generally parallel to and radially outwardly spaced from the wheel axle, said generally circular wall being received within a complementary shaped opening of the wheel support for rotatably mounting the wheel;

the wheel axle having an outer free end that extends beyond the complementary shaped opening in the wheel support and is provided with locking means for locking engagement with the wheel support independent of the rotatably mounted wheel; and said wheel support including an integral frame plate extending above the wheel for cooperative interengagement with an associated supporting frame.

2. The wheel mount as defined in claim 1 wherein the locking means at the free end of the axle element also includes a bearing support for the generally circular wall when mounted within the complementary shaped opening of the wheel support.

3. A wheel mount for rotatably mounting a wheel relative to a supporting frame, comprising:

a wheel having an integral centrally positioned axle element extending transversely relative to said wheel;

a wheel support including a complementary shaped wheel axle element opening extending therethrough to provide a rotatable mounting for said wheel, said wheel support having a predetermined thickness and including a front wall and a rear wall adjacent the wheel axle element opening;

said wheel being connected to said wheel axle element adjacent an inner end of said wheel, said wheel also including a transversely extending wall that surrounds said wheel axle element and terminates in a generally circular wall that extends normal to said transversely extending wall in generally parallel relationship to said wheel axle element, said generally circular wall being received within the wheel axle element opening for rotatably mounting the wheel;

said wheel axle element having a predetermined length greater than the predetermined thickness of said wheel support, said wheel axle element terminating in an outer free end spaced from said wheel;

deflectable shoulder means provided at the outer free end of said wheel axle element, said deflectable shoulder means having a predetermined width greater than the complementary shaped wheel axle element opening for partial inward deflection of said deflectable shoulder means during assembly of the wheel to said wheel support, said deflectable shoulder means returning to its predetermined width when the deflectable shoulder means extends beyond the complementary shaped wheel axle element opening for locking engagement with the rear wall of the wheel support in order to position the wheel in general proximity to the front wall of the wheel support; and said wheel support including an integral frame plate extending above the wheel for cooperative interengagement with an associated supporting frame, in order to mount said wheel support to said supporting frame while permitting rotation of said wheel relative to said wheel support.

4. The wheel mount as defined in claim 3 wherein the transversely extending wall is axially spaced inwardly from the inner end of said wheel axle element, said transversely extending wall connected at one end to said wheel axle element and a second end connected to a first end of a tapered wall, said tapered wall having a second end connected to a transverse wheel wall which terminates in and is connected to a circular wheel wall that is spaced from and generally parallel to the circular wall surrounding the wheel axle element.

5. The wheel mount as defined in claim 4 wherein said deflectable shoulder means comprise deflectable finger segments integral with said wheel axle element each terminating in a radially enlarged shoulder at an outer free end of said wheel axle element.

6. The wheel mount as defined in claim 5 wherein the integral frame plate of said wheel support comprises a fan shaped element that is adapted to be received in a complementary shaped opening provided in said supporting frame.

7. The wheel mount as defined in claim 3 wherein the deflectable shoulder means at the free end of the axle element also includes a bearing support for the generally circular wall when mounted within the wheel axle element opening.

* * * * *